US006659793B1

(12) United States Patent
Chung et al.

(10) Patent No.: US 6,659,793 B1
(45) Date of Patent: Dec. 9, 2003

(54) ELECTRICAL CONNECTOR ASSEMBLY WITH EXTRACTION TOOL

(75) Inventors: Yung Chien Chung, Tu-Chen (TW); Hsien-Chu Lin, Tu-Chen (TW); Chieh Chao Yu, Tu-chen (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/302,518

(22) Filed: Nov. 22, 2002

(30) Foreign Application Priority Data

Sep. 9, 2002 (TW) ..... 91214025 U

(51) Int. Cl.[7] ..... H01R 13/00
(52) U.S. Cl. ..... 439/483; 29/764
(58) Field of Search ..... 439/483, 484, 439/476.1, 152; 29/762, 764

(56) References Cited

U.S. PATENT DOCUMENTS 3,654,589 A * 4/1972 Di Stefano et al. ..... 439/483
4,290,193 A 9/1981 Anderton et al.
4,805,298 A 2/1989 Takahashi
4,961,256 A * 10/1990 Faillace ..... 29/764
5,062,803 A * 11/1991 Howard et al. ..... 439/160
5,446,622 A * 8/1995 Landry et al. ..... 361/737
5,516,305 A * 5/1996 Haluska ..... 439/484
6,249,960 B1 * 6/2001 Faesel ..... 29/762

FOREIGN PATENT DOCUMENTS

JP 2001-035592 2/2001

* cited by examiner

*Primary Examiner*—Gary Paumen
*Assistant Examiner*—James R. Harvey
(74) *Attorney, Agent, or Firm*—Wei Te Chung

(57) ABSTRACT

A cable assembly (100) has an electrical connector (2), a cable (22), and an extraction tool (1) for extracting the electrical connector from a mated connector. The extraction tool has a mounting hole (10) assembled to the electrical connector, a first cavity (12) for the cable extending therethrough, a first slot (120) defined therein and communicating with the first cavity. The extraction tool further defines a second cavity (14) for receiving the cable and a second slot (140) communicating with the second cavity.

1 Claim, 3 Drawing Sheets

ELECTRICAL CONNECTOR ASSEMBLY WITH EXTRACTION TOOL

CROSS-REFERENCE TO RELATED APPLICATION

This present application is related to a U.S. patent application Ser. No. 10/120633, invented by David Tso-Chin Ko, entitled "EXTRACTION TOOL FOR EXTRACTING ELECTRICAL CONNECTOR" filed on Apr. 4, 2002; and application Ser. No. 10/302,473 entitled "ELECTRICAL CONNECTOR ASSEMBLY WITH PULL TAB", contemporaneously filed and invented by Yong-qian Zhong et al., assigned to the common assignee. Copies of the specifications are hereto attached.

BACKGROUND OF THE INVENTION

1. Field of the Invention

The present invention generally relates to a cable assembly, and more particularly to a cable assembly having an extraction tool providing a robust holding of the cable assembly for separating the connector from a mated connector.

2. Brief Description of the Related Art

The connector becomes smaller and smaller so as to benefit a thin, compact, and robust electrical device. As a result, it will be very difficult to get hold of it when it is removed from a mated connector. Sometimes the connectors are pulled out by their associated cables, which will destroy the electrical connection between the connectors and the cables. Some extractor tools have been invented to solve above-mentioned questions.

U.S. Pat. No. 4,961,256, issued to Faillace on Oct. 9, 1990, discloses an extraction tool inserted between an electrical connector. The extraction tool has a level arm and a pair of object-contacting arms. The extraction tool is useful for separating objects from other devices. However the extraction tool of Faillace patent occupies large outer space which does not meet trend of electronic devices.

JP Pat. Publication No. 2001-035592, issued on Feb. 9, 2001, discloses an L-shaped extraction tab for extracting a connector from a periphery equipment. The L-shaped extraction tab has a cylindrical part mating with the connector, an action part and a knob part extending from a free end of the action part, the action part further defines a recess for a cable of the connector to extend through. However, the recess defined in the extraction tab is much large, so that the cable may escape therefrom. Furthermore, the action part and the knob extend upwardly from the cable of the electrical connector, which occupies more space and an extra force may be exerted on the action part by accident to pull the electrical connector from the periphery equipment.

U.S. application patent Ser. No. 10/120633, assigned to the same assignee as the present invention, discloses a related pull tab for extracting an electrical connector from a mated connector, the pull tab has an engaging portion and a handling portion, the engaging portion has an engaging opening assembled to the electrical connector, and the handling portion defines a retaining aperture at a free end thereof receiving a cable of the electrical connector. However the retaining aperture is defined much big so that the cable may escape therefrom easily. Furthermore, the engaging portion engages with a shell or a cable retaining portion of the electrical connector, so that an outer force may not be transferred properly.

Hence, an improved extraction tool is desired to overcome the above-mentioned shortcomings.

BRIEF SUMMARY OF THE INVENTION

It is an object of this invention to provide a cable assembly with an extraction tool facilitating extracting the cable assembly from a mated connector and occupying less space.

A cable assembly has an electrical connector, and an extraction tool for extracting the electrical connector from a mated connector. The extraction tool has a mounting portion and a handling portion. The mounting portion defines a mounting hole assembled to the electrical connector. The handling portion defines a first cavity for a cable of the electrical connector extending therethrough, a first sidelong slot defined communicating with the first cavity and a second cavity for receiving the cable. The first slot facilitates the assembling of the cable into the first cavity of the extraction tool, Other objects, advantages and novel features of the invention will become more apparent from the following detailed description of a preferred embodiment when taken in conjunction with the accompanying drawings.

DETAILED DESCRIPTION OF THE INVENTION

Figure 1:
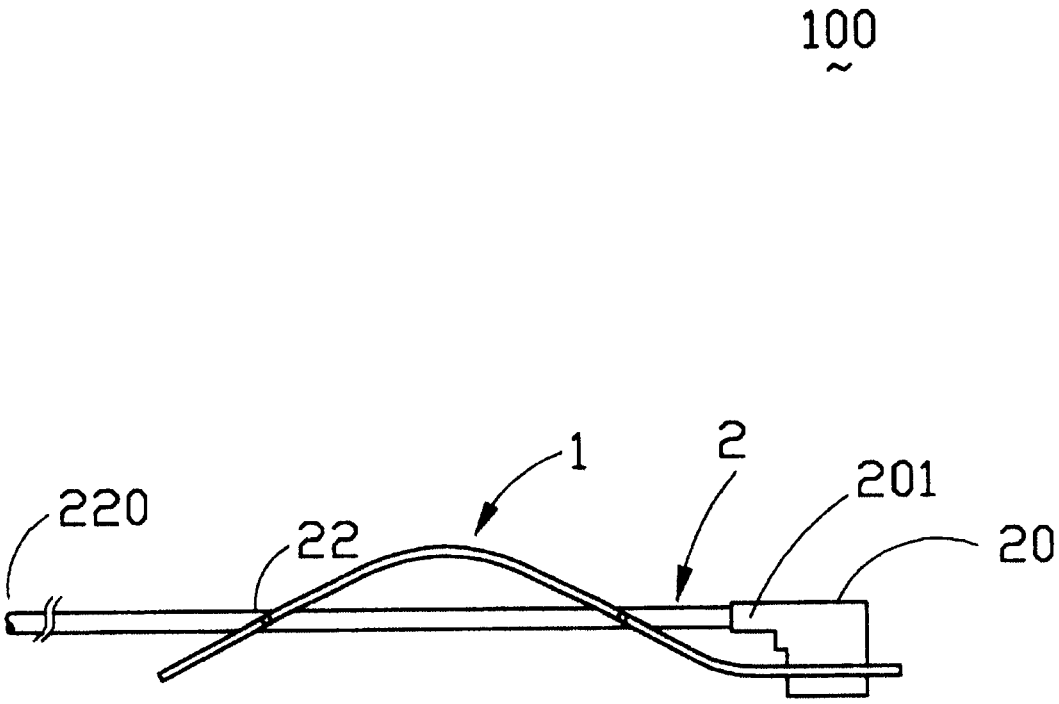
FIG. 1 is a front view of a cable assembly with an extraction tool of the present invention.
Figure 2:
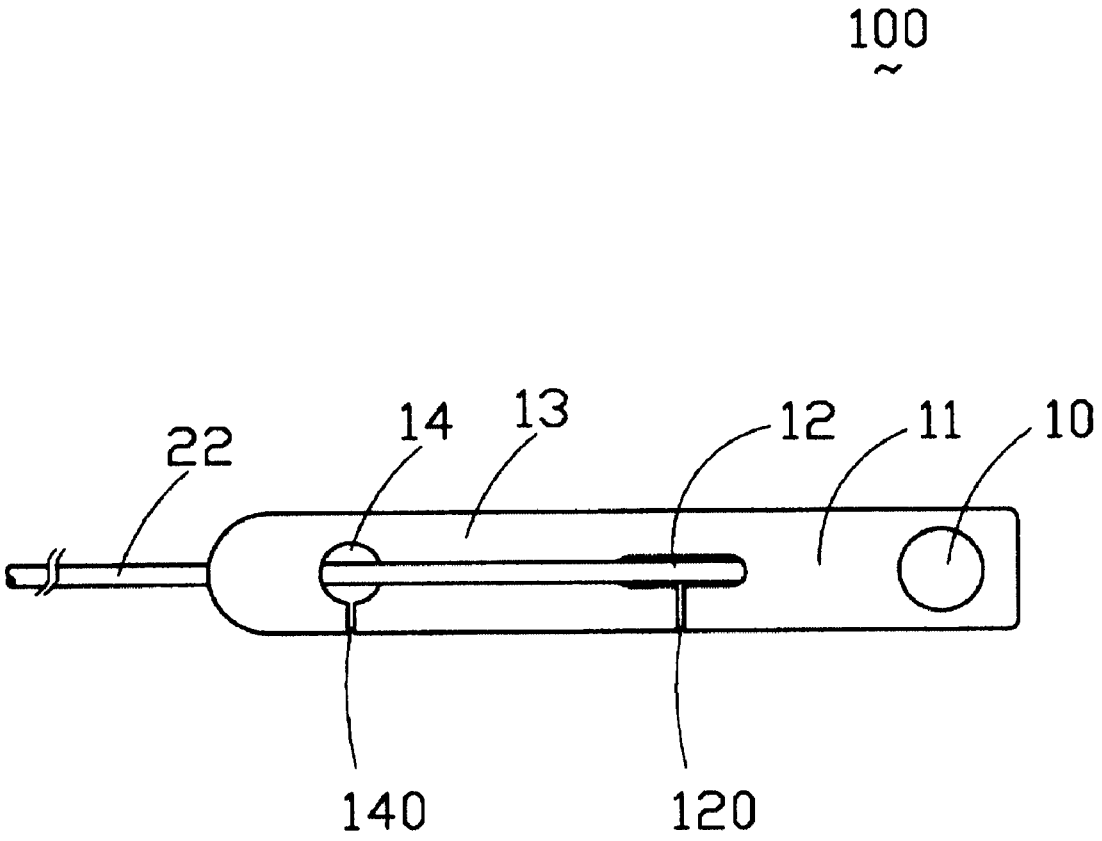
FIG. 2 is a top view of the extraction tool of FIG. 1.
Figure 3:
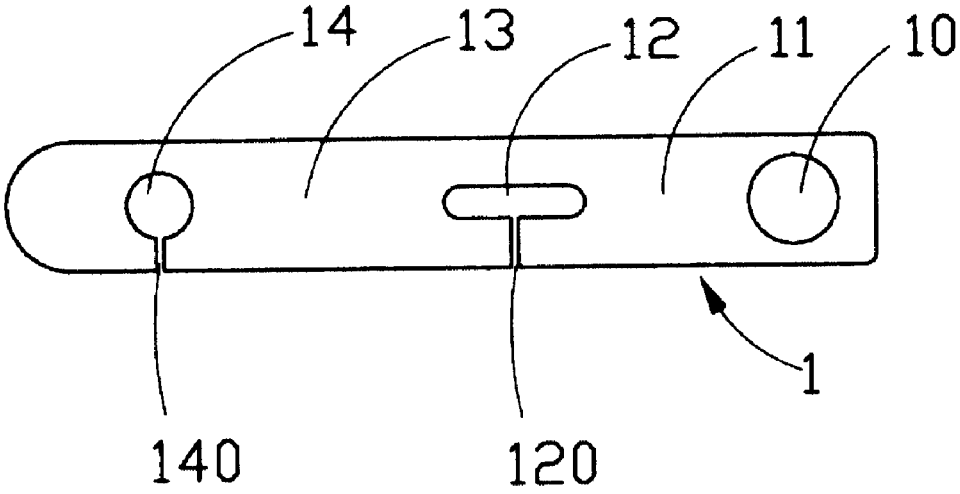
FIG. 3 is a top view of the cable assembly of FIG. 1.

Referring to FIGS. 1, 2 and 3, a cable assembly 100 has an electrical connector 2 and an extraction tool 1 for extracting the electrical connector 2 from a mated connector (not shown). The electrical connector 2 has a mating portion 20, a cable 22 and a retaining portion 201 retaining the cable 22 into the mating portion 20.

The extraction tool 1 has a mounting potion 11 and a handling portion 13 extending from the mounting portion 11. The mounting portion 11 defines a mounting hole 10 adjacent to a free end thereof. The mounting hole 10 has a diameter substantially equal to an exterior diameter of the mating portion 20 of the electrical connector 2. The handling portion 13 defines a first cavity 12 adjacent to the mounting portion 11 with a width less than the diameter of the mounting hole 10, a first slot 120 at a side portion thereof communicating with the first cavity 12. The handling portion 13 further defines a second cavity 14 at a free end thereof, and a second slot 140 communicating with the second cavity 14.

In assembly, a free end 220 of the cable 22 is soldered to an electrical element (not shown), the mounting hole 10 of the extraction tool 1 encircles the mating portion 20 of the electrical connector 2. The cable 22 of the electrical connector 2 extends into the first cavity 12 of the extraction tool 1 by passing through the first slot 120 of the extraction tool 1, thus the handling portion 13 extends upwardly from the cable 22 of the electrical connector 2. The cable 22 of the electrical connector 2 is inserted into the second cavity 14 of the extraction tool 1 by passing through the second slot 140, thus a free end of the handling portion 13 extends under the cable 22 of the electrical connector 2.

In use, the cable 22 of the electrical connector 2 disengages the second cavity 14 of the handling potion 13 from the second slot 140. An outer force is exerted on the handling portion 13 of the extraction tool 1 and is transferred to the electrical connector 2 by the engagement of the mating portion 20 and the mounting hole 10. Thus, the cable assembly 100 is extracted from a mated connector.

An advantage of the present invention over the prior art results from the fact that the extraction tool 1 of the cable assembly 100 defines a first cavity 12 and a first slot 120 communicating with the first cavity 12, thus the cable 22 of the electrical connector 2 may be assembled into the first cavity 12 through the first slot 120 which facilitating the assembly of the cable assembly 100, as a result, the first cavity 12 may be much small, the cable 22 may not escape from the first cavity 12 of the extraction tool 1. Another advantage of the present invention over the prior art results from the fact that the second cavity 14 and the second slot 140 communicating with the second cavity 14 are defined in the free end of the handling portion 13. The free end of the handling portion 13 engages with the cable 22 of the electrical connector 2 through the second cavity 14 and the second slot 140. As a result, the free end of the handling portion 13 occupies less space, and an improper outer force exerted on the extraction tool 1 may be prevented It is to be understood, however, that even though numerous, characteristics and advantages of the present invention have been set forth in the foregoing description, together with details of the structure and function of the invention, the disclosed is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector assembly, comprising an electrical connector having a mating portion and a cable; and an extraction tool, the extraction tool having a mounting hole assembled to the mating portion of the electrical connector, a first cavity and a second cavity respectively receiving the cable of the electrical connector;

wherein the extraction tool has a mounting portion and a handling portion curved from the mounting portion;

wherein the mounting hole and the first cavity are respectively defined in the mounting portion and the handling portion of the extraction tool;

wherein the handling portion defines a first sidelong slot communicating with the first cavity;

wherein the second cavity is defined in the handling portion adjacent to a free end thereof;

wherein the handling portion defines a second sidelong slot communicating with the second cavity.

* * * * *